US009296574B2

(12) United States Patent
Taniguchi

(10) Patent No.: US 9,296,574 B2
(45) Date of Patent: Mar. 29, 2016

(54) SHEET FEEDING APPARATUS AND IMAGE FORMING APPARATUS

(71) Applicant: CANON KABUSHIKI KAISHA, Tokyo (JP)

(72) Inventor: Koichi Taniguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/967,438

(22) Filed: Aug. 15, 2013

(65) Prior Publication Data

US 2014/0070480 A1 Mar. 13, 2014

(30) Foreign Application Priority Data

Sep. 7, 2012 (JP) ..... 2012-196979

(51) Int. Cl.

| | |
|---|---|
| ***B65H 3/06*** | (2006.01) |
| ***B65H 1/08*** | (2006.01) |
| ***B65H 1/18*** | (2006.01) |
| ***B65H 1/14*** | (2006.01) |
| ***B65H 7/04*** | (2006.01) |

(52) U.S. Cl.

CPC ..... *B65H 3/0684* (2013.01); *B65H 1/08* (2013.01); *B65H 1/14* (2013.01); *B65H 1/18* (2013.01); *B65H 7/04* (2013.01); *B65H 2403/544* (2013.01); *B65H 2403/72* (2013.01); *B65H 2403/942* (2013.01); *B65H 2405/1117* (2013.01); *B65H 2511/51* (2013.01); *B65H 2513/40* (2013.01); *B65H 2801/06* (2013.01)

(58) Field of Classification Search

CPC ..... B65H 1/08; B65H 1/12; B65H 1/14; B65H 1/18; B65H 1/20; B65H 3/06; B65H 3/0684; B65H 2405/1117; B65H 7/04

USPC ..... 271/110, 117, 118, 152, 153, 126, 127

See application file for complete search history.

(56) References Cited

U.S. PATENT DOCUMENTS

| | | | | | |
|---|---|---|---|---|---|
| 5,295,678 | A * | 3/1994 | Lindner | B65H 1/18 | 271/152 |
| 5,732,307 | A * | 3/1998 | Yoshizuka | G03G 15/6508 | 271/110 |
| 5,842,694 | A * | 12/1998 | Brooks | B65H 1/14 | 271/110 |
| 5,988,628 | A | 11/1999 | Mori | | |
| 6,994,341 | B2 * | 2/2006 | Aoki | B65H 1/18 | 271/117 |

(Continued)

FOREIGN PATENT DOCUMENTS

| | | | |
|---|---|---|---|
| EP | 2033915 | A2 | 3/2009 |
| JP | 6-329275 | A | 11/1994 |
| JP | 2009-062158 | A | 3/2009 |

*Primary Examiner* — Prasad Gokhale

(74) *Attorney, Agent, or Firm* — Fitzpatrick, Cella, Harper & Scinto

(57) ABSTRACT

Provided are a sheet feeding apparatus and an image forming apparatus, which can set a sheet feeding interval to be short. The controller determines whether a sheet surface height of an uppermost sheet becomes a predetermined sheet surface height, based on a detection signal from a lower limit detection sensor, when a pickup roller abuts the uppermost sheet. When determining that the sheet surface height of the uppermost sheet becomes the predetermined sheet surface height, the controller feeds a predetermined number of sheets without performing detection by the lower limit detection sensor, and then controls a motor such that the uppermost sheet is located with an appropriate range by lifting a tray when feeding a next sheet.

17 Claims, 14 Drawing Sheets

(56) References Cited

U.S. PATENT DOCUMENTS

| | | | | |
|---|---|---|---|---|
| 7,802,784 | B2 * | 9/2010 | Yamamoto | B65H 1/14 271/111 |
| 7,971,868 | B2 * | 7/2011 | Matsushima | B65H 1/14 271/117 |
| 8,123,212 | B1 | 2/2012 | Blair et al. | |
| 8,246,042 | B2 * | 8/2012 | Gagnon | B65H 3/0684 271/117 |
| 8,322,709 | B2 | 12/2012 | Blair et al. | |
| 8,494,414 | B2 | 7/2013 | Taniguchi | |
| 2001/0017440 | A1 * | 8/2001 | Minamishin | B65H 1/14 271/10.11 |
| 2007/0182085 | A1 * | 8/2007 | Nakashima | B65H 1/14 271/126 |
| 2009/0066009 | A1 | 3/2009 | Matsushima et al. | |
| 2009/0224462 | A1 * | 9/2009 | Yamamoto | B65H 1/14 271/18 |
| 2010/0320676 | A1 * | 12/2010 | Gagnon | B65H 3/0684 271/145 |
| 2012/0139179 | A1 * | 6/2012 | Blair | B65H 1/14 271/10.01 |
| 2012/0326381 | A1 * | 12/2012 | Inoue | B65H 3/0607 271/117 |
| 2013/0221607 | A1 * | 8/2013 | Chiba | B65H 3/0684 271/117 |
| 2014/0070481 | A1 * | 3/2014 | Kosuga | B65H 1/14 271/110 |

* cited by examiner

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and in particular, to a sheet feeding apparatus configured to feed a stacked sheet to a body of an image forming apparatus one by one from the top.

2. Description of the Related Art

Nowadays, as an image forming apparatus such as a copying machine, a printer, and a facsimile machine, an image forming apparatus including a sheet feeding apparatus feeding a sheet, on which an image is to be formed, to an image forming portion, is widely used. Generally, in a sheet feeding apparatus, a sheet is stacked on a tray capable of being lifted up to and down from a sheet feeding cassette, and the sheet stacked on the tray are fed by a pickup roller provided in an apparatus body.

In the sheet feeding apparatus, for cost reduction, the pickup roller is driven by a motor capable of rotating clockwise and counterclockwise, and simultaneously, the tray is lifted and lowered. For example, a sheet feeding operation is performed by driving the pickup roller by clockwise rotation of the motor, and a lift-up operation is performed by lifting the tray by counterclockwise rotation of the motor. That is, both the sheet feeding operation and the lift-up operation are performed by using one motor to switch motor rotation between a clockwise direction and a counterclockwise direction, thereby reducing the cost of the apparatus.

Also, as a sheet feeding method, there is a method that abuts a liftable and lowerable pickup roller on a sheet by lowering the pickup roller when the sheet is fed, and lifts the pickup roller after the fed sheet reaches a separating portion or a conveying portion of a downstream side. In this manner, the uppermost sheet can be certainly fed separately by lifting and lowering the pickup roller whenever the sheet is fed.

In this method, a sensor that detects a position of the pickup roller is provided. In feeding the sheet, the sensor detects a position when the pickup roller has been lowered. At the time of sheet feeding, the pickup roller is lowered by rotating the motor clockwise, and the height of the top surface of the uppermost sheet (hereinafter, referred to as a sheet surface height) on the tray is determined based on the detection from the sensor after a lapse of a predetermined time. When it is determined based on the detection of the sensor that the height is low, the uppermost sheet moves to a height of a feedable range by performing a lift-up operation by rotating the motor counterclockwise before a next sheet feeding operation (see U.S. Pat. No. 5,988,628).

However, nowadays, improvement in productivity (number of image-formed sheet per unit time) is required from market demands. In order to realize this, it is necessary to increase a process speed or narrow a sheet interval (interval between before and after the successively conveyed sheet). However, if the process speed is increased or the sheet interval is narrowed, a sheet feeding interval (sheet discharging interval) from a sheet feeding cassette is shortened.

As such, in the control that lowers the pickup roller when the sheet feeding interval is shortened, and performs the lift-up operation by determining the lift-up operation after a lapse of a predetermined time, it is difficult to match a timing of a sheet feeding operation with a feeding timing of a next sheet after the fed sheet. That is, there is a risk that feed failure will occur because the lift-up operation is not ended at the feeding timing.

FIG. 14 is a flowchart of a sheet feeding sequence of the sheet feeding apparatus according to the related art. In the sheet feeding apparatus according to the related art, a sheet feeding operation is started, and a sheet is fed by rotating a pickup roller while being pressed on a sheet (Step 11). Next, the pickup roller is lifted (Step 12). Next, when a rear end of the fed sheet passes through a separating portion, the pickup roller is lowered at substantially the same time (Step 13). Next, when 50 ms has elapsed, it is determined whether a sheet surface height is a lower limit, based on detection of a detection sensor (Step 14). When the sheet surface height is not the lower limit (NO in Step 14), a next sheet is fed by rotating the pickup roller (Step 11). Also, the lower limit of the sheet surface height refers to a case where a height of a top surface of an uppermost sheet stacked on a tray is a lower limit of a sheet feedable range. When it is determined that the sheet surface height is the lower limit, the height of the top surface of the sheet is lifted by lifting the tray.

Also, when the controller determines that the sheet surface is low, that is, the sheet surface height is the lower limit, based on the detection of the detection sensor (YES in Step 14), the controller performs the lift-up operation until the sheet surface height becomes the sheet feedable range, based on the detection of the detection sensor (Step 15).

Also, as a timing of detecting the sheet surface height, the detection of the sheet surface height is performed after a predetermined time (for example, 50 ms) from a pickup roller lowering start signal, from an electrical delay and a mechanical operation time of a solenoid for lifting the pickup roller. Also, in order to secure the stable sheet feeding operation, a lift-up time of a predetermined time (for example, minimum 100 ms) is required as a time for performing the lift-up operation. The reason why the 100-ms lift-up operation is required is to solve a transmission loss caused by backlash of a gear at the time of switching the clockwise/counterclockwise rotation of the motor.

Also, in this sequence, after the lift-up operation, a next sheet feeding operation is performed after a lapse of a stabilization time of the motor. This is because when the sheet feeding and lift-up operation by the pickup roller is performed by the switching of the clockwise/counterclockwise rotation of the motor, the motor needs to be stopped once at the time of switching the rotating direction. Also, there is a risk that the motor will step out when the rotating operation is started without stabilization time. For this reason, the stabilization time of, for example, 100 ms, is provided after the stop.

As such, in the existing sequence, if minimum 250 ms has not elapsed after the sheet is fed, the next sheet feeding operation cannot be performed. Therefore, it is impossible to sufficiently cope with the demand for the improvement of productivity. That is, in the conventional sequence, the sheet feeding interval cannot be set to be short, it is impossible to sufficiently cope with the demand for the improvement of productivity.

Therefore, the present invention has been made in view of such circumstances, and is directed to provide a sheet feeding apparatus and an image forming apparatus, which can set a sheet feeding interval to be short.

SUMMARY OF THE INVENTION

The present invention is a sheet feeding apparatus including: a sheet storage portion including a sheet stacking plate which is capable of lifting and lowering and on which a sheet is stacked; a lift-up mechanism which lifts the sheet stacking plate; a sheet feeding portion which is liftable and lowerable and is lowered to abut a top surface of a sheet stacked on the sheet stacking plate and feed the sheet; a detecting portion which outputs a detection signal according to a position of the sheet feeding portion when the sheet feeding portion abuts a top surface of an uppermost sheet among the sheet supported by the sheet stacking plate; and a controller which determines a sheet surface eight of the uppermost sheet based on the detection signal from the detecting portion, feeds a sheet when determining the sheet surface height of the uppermost sheet is a lower-limit height that is preset, and controls the lift-up mechanism such that the sheet surface height of the uppermost sheet becomes higher than the lower-limit height by lifting the sheet stacking plate when feeding a sheet next to the fed sheet.

According to the present invention, in the case where the sheet surface height of the uppermost sheet becomes a predetermined sheet surface height, the sheet stacking plate is lifted up when a next sheet is fed after a predetermined number of sheets are fed, thereby reducing the sheet feeding interval.

Further features of the present invention will become apparent from the following description of exemplary embodiments with reference to the attached drawings.

DESCRIPTION OF THE EMBODIMENTS

Figure 1:
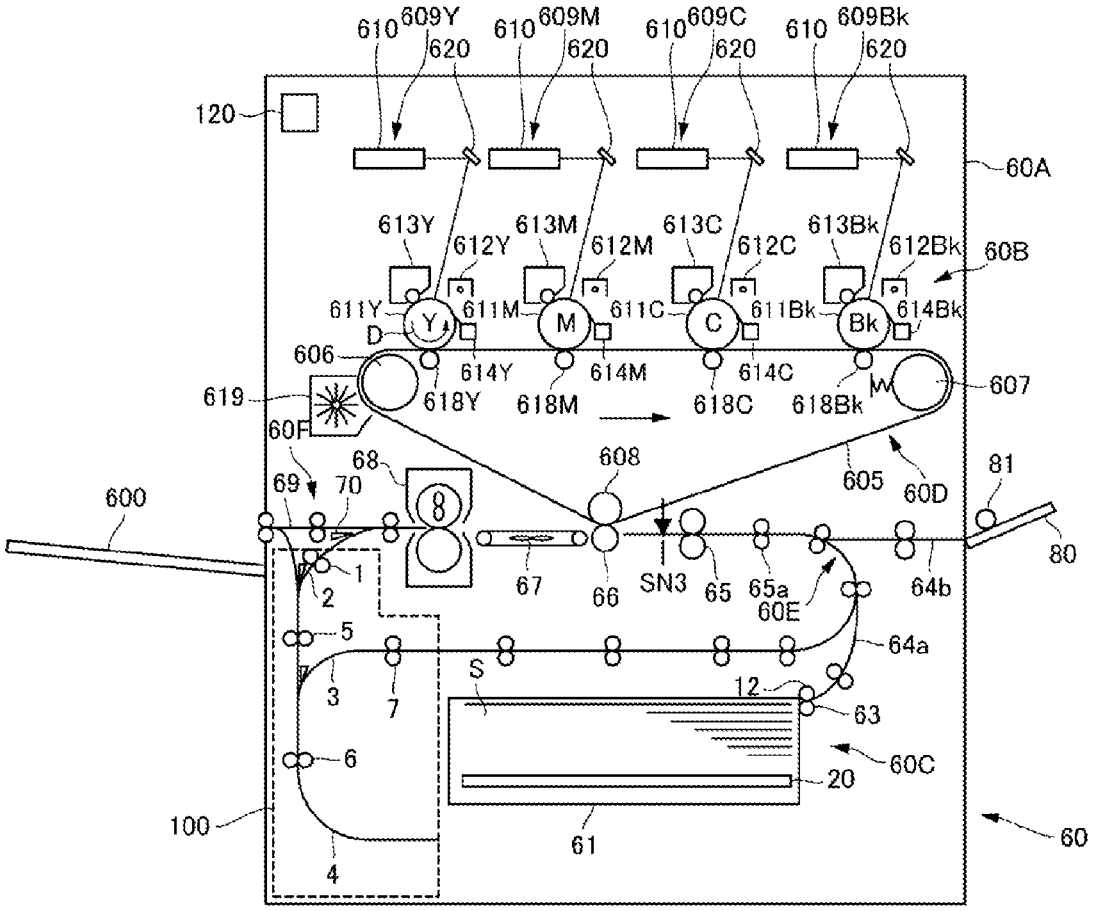
FIG. 1 is a diagram illustrating a schematic configuration of a color image forming apparatus as an example of an image forming apparatus including a sheet feeding apparatus according to an embodiment of the present invention.

Hereinafter, embodiments of the present invention will be described in detail with reference to the drawings. FIG. 1 is a diagram illustrating a schematic configuration of a color image forming apparatus as an example of an image forming apparatus including a sheet feeding apparatus according to an embodiment of the present invention.

Referring to FIG. 1, a color image forming apparatus 60 includes a color image forming apparatus body (hereinafter referred to as "apparatus body") 60A. The apparatus body 60A includes an image forming portion 60B, a sheet feeding apparatus 60C which feeds a sheet S, and a transfer portion 60D which transfers a toner image formed by the image forming portion 60B to the sheet S fed by the sheet feeding apparatus 60C.

Also, referring to FIG. 1, a sheet conveying apparatus 60E conveys the sheet S fed by the sheet feeding apparatus 60C to the transfer portion 60D. The sheet conveying apparatus 60E includes a registration roller 65 which is a pre-imaging skew feeding correcting portion which corrects timing and skew feeding of the sheet S, and a conveying roller 65*a* which conveys the sheet S to the registration roller 65. Also, a manual feed tray 80 is provided at a side of the apparatus body.

Also, a main body controller 120 controls an image forming operation of the color image forming apparatus 60. When forming an image on both sides of the sheet S, a reverse conveying apparatus 100 constitutes a sheet reverse portion which reverses the sheet and conveys the reserved sheet to the image forming portion 60B. The reverse conveying apparatus 100 includes a reverse guide path 2, a switchback path 4, and a duplex conveying path 3. A post-registration sensor SN3 detects a position in a width direction perpendicular to a sheet conveying direction of the sheet whose skew feeding is corrected by the registration roller 65, and is disposed downstream of the registration roller 65.

Herein, the image forming portion 60B includes four yellow (Y), magenta (M), cyan (C) and black (Bk) image forming units 609 (609Y, 609M, 609C and 609Bk). Also, the image forming units 609 respectively include a photosensitive drum 611 (611Y, 611M, 611C and 611Bk) and a charging apparatus 612 (612Y, 612M, 612C and 612Bk). Also, the image forming units 609 respectively include an exposure apparatus 610, a development device 613 (613Y, 613M, 613C and 613Bk), and a primary transfer unit 618 (618Y, 618M, 618C and 618Bk).

The sheet feeding apparatus 60C stores a sheet S stacked on a tray 20, and includes a sheet feeding cassette 61 which is drawable, and a pickup roller 12 that is a sheet feeding portion which discharges the sheet S stored in the sheet feeding cassette 61. The transfer portion 60D includes an intermediate transfer belt 605 that is stretched by a driving roller 606, a tension roller 607, and a secondary transfer inner roller 608, and is conveyance-driven in the direction of an arrow in the drawing.

Herein, on the intermediate transfer belt 605, a toner image formed on the photosensitive drum is transferred by an electrostatic load bias and a predetermined pressure applied by the primary transfer unit 618. Also, in a secondary transfer portion formed by the secondary transfer inner roller 608 and a secondary transfer outer roller 66 which substantially face each other, a predetermined pressure and an electrostatic load bias are applied to adsorb an unfixed image to the sheet S.

Also, a cleaner 619 is provided at a downstream portion of the secondary transfer inner roller 608 to recover a toner left on the intermediate transfer belt 605.

In this color image forming apparatus 60, in order to form an image, first, the surface of the photosensitive drum 611 is uniformly pre-charged by the charging apparatus 612. Thereafter, image data is received by the body controller 120 and is transmitted to the exposure apparatus 610. Accordingly, based on a signal of image information transmitted, the exposure apparatus 610 emits light onto the photosensitive drum 611 rotating in the direction of an arrow. Then, by reflecting and irradiating the light by a folding mirror 620, a latent image is formed on the surface of the photosensitive drum.

Next, with respect to the latent image formed on the photosensitive drum 611, toner development is performed by the development device 613, to form a toner image on the photosensitive drum. Thereafter, a predetermined pressure and an electrostatic load bias are applied by the primary transfer unit 618, to transfer a toner image on the intermediate transfer belt 605.

Herein, image formation by the respective Y, M, C and Bk image forming units 609 is performed at the timing of overlapping with the upstream toner image primarily transferred on the intermediate transfer belt. As a result, finally, a full-color toner image is formed on the intermediate transfer belt 605. The sheet S is discharged from the sheet feeding cassette 61 by the pickup roller 12 according to the image forming timing of the image forming portion 60B. Thereafter, the sheet S passes from a conveying path 64*a* through the conveying roller 65*a*, and is conveyed to the registration roller 65. Also, in the case of manual sheet feeding, the sheet stacked on the manual feed tray 80 is discharged by a sheet feeding roller 81, and is conveyed from a conveying path 64*b* through the conveying roller 65*a* to the registration roller 65.

Then, after skew feeding and timing correction are performed in the registration roller 65, the sheet is conveyed to the secondary transfer portion formed by the secondary transfer inner roller 608 and the secondary transfer outer roller 66 that substantially face each other. Thereafter, in the secondary transfer portion, by applying a predetermined pressure and an electrostatic load bias, a full-color toner image is secondarily transferred on the sheet S.

Next, the sheet S, on which the toner image has been secondarily transferred, is conveyed to a fixing unit 68 by a pre-fixing conveying portion 67. Then, in the fixing unit 68, a predetermined pressure by a roller or a belt substantially facing each other, and a heating effect by a heat source such as heater, are applied to fuse and fix a toner on the sheet S. Next, the sheet S having the fixed image is discharged by a branch conveying apparatus 60F through a sheet discharge conveying path 69 onto a sheet discharge tray 600.

In the case of duplex printing for forming an image on both sides of the sheet S, by the switching of a switching member 70 provided at the branch conveying apparatus 60F, the sheet S is conveyed to the reverse guide path 2 of the reverse conveying apparatus 100. Thereafter, by a conveying roller 1 and an ante-reversal conveying roller 5 provided in the reverse guide path 2, the sheet S is drawn into the switchback path 4. Also, by a switchback operation of a reversing roller 6 that is provided in the switchback path 4 and is capable of rotating clockwise and counterclockwise, the sheet S drawn into the switchback path 4 is conveyed to the duplex conveying path 3 with its front and rear ends switched.

Next, by a post-reversal conveying roller 7 provided in the duplex conveying path 3, the sheet is joined at a conveying path 64 according to the timing with a sheet of a subsequent job, which is conveyed from the sheet feeding apparatus 60C, and is sent through the registration roller 65 to the secondary transfer portion. Since an image forming process for the rear surface (second surface) is the same as that for the above-described surface (first surface), a description thereof will not be repeated.

Figure 2:
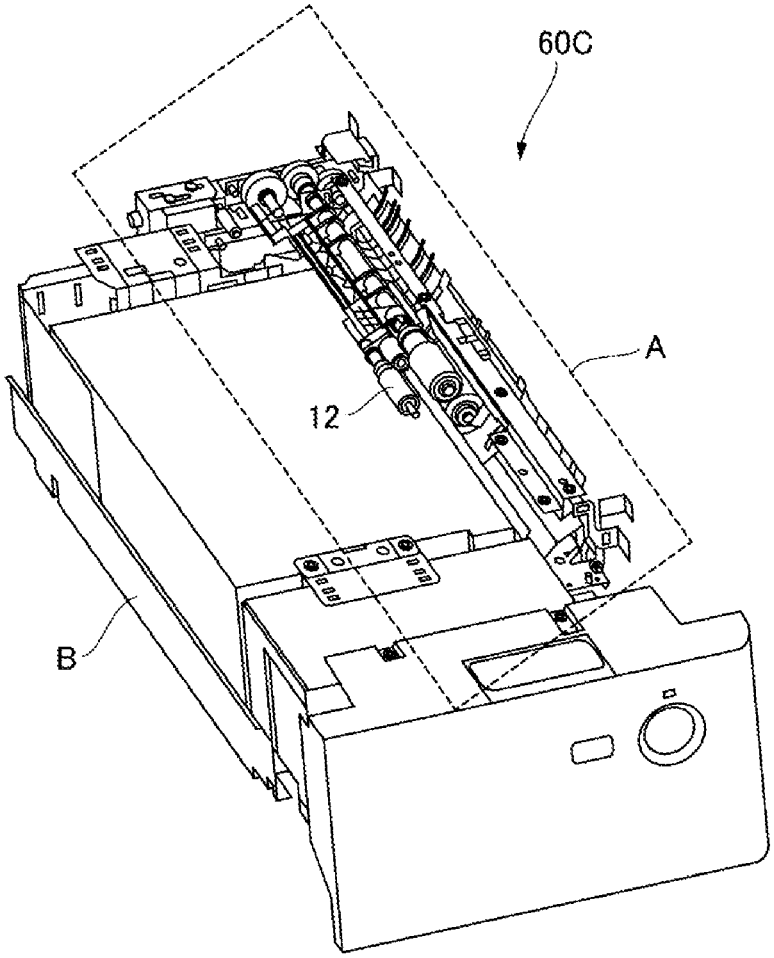
FIG. 2 is a diagram illustrating a configuration of the sheet feeding apparatus.
Figure 3:
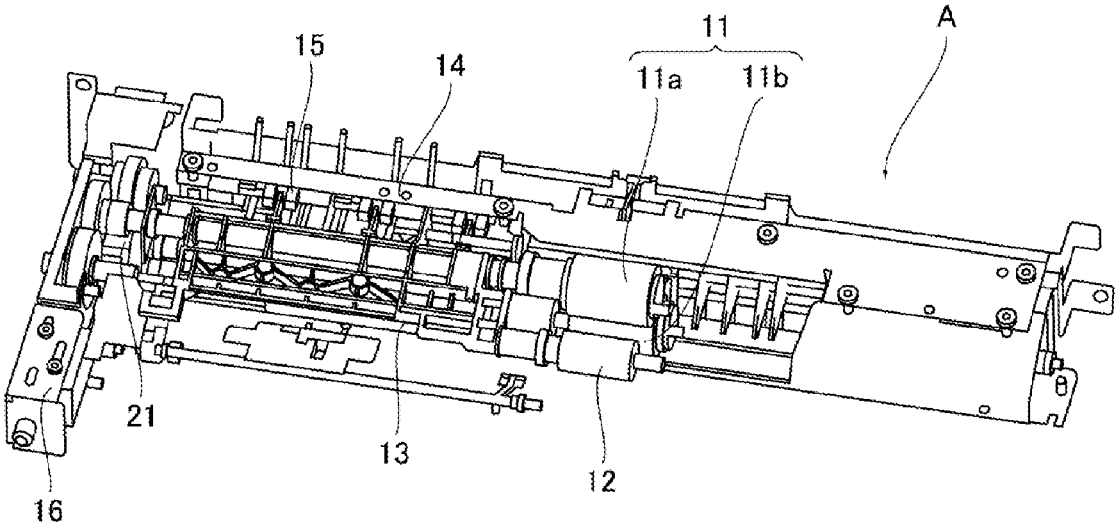
FIG. 3 is a diagram illustrating a configuration of a sheet feeding portion provided in the sheet feeding apparatus.

FIG. 2 is a diagram illustrating a configuration of the sheet feeding apparatus 60C. The sheet feeding apparatus 60C includes a sheet feeding portion A having a pickup roller 12 capable of lifting and lowering, and a sheet storage portion B having a sheet feeding cassette 61. As illustrated in FIG. 3, in addition to the pickup roller 12, the sheet feeding portion A includes a separation roller pair 11 including a conveying roller 11*a* and a separation roller 11*b*. The sheet discharged by the pickup roller 12 is separated one by one by the separation roller pair 11.

Figure 4:
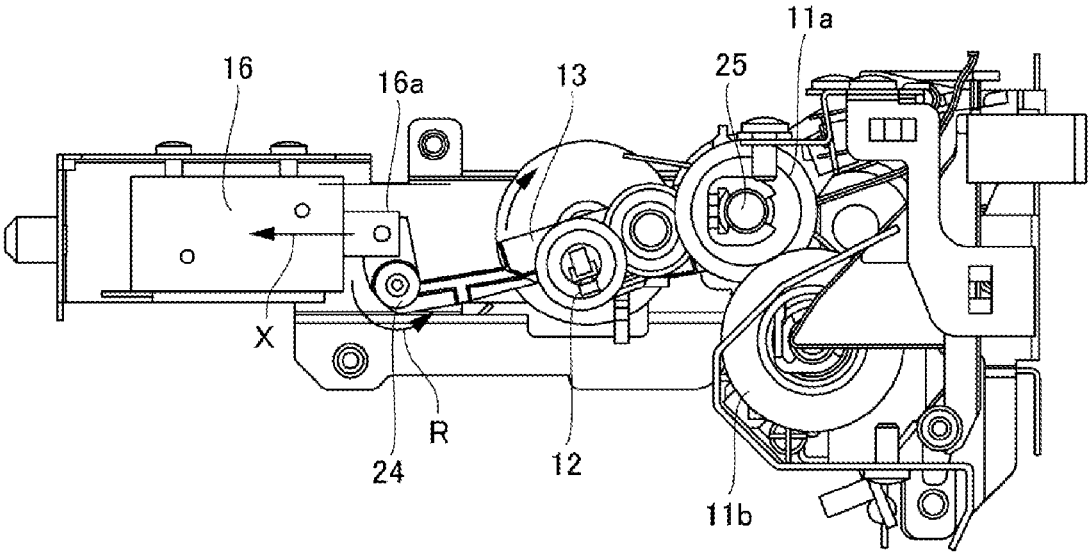
FIG. 4 is a diagram illustrating a configuration of a pickup roller provided in the sheet feeding portion.
Figure 7:
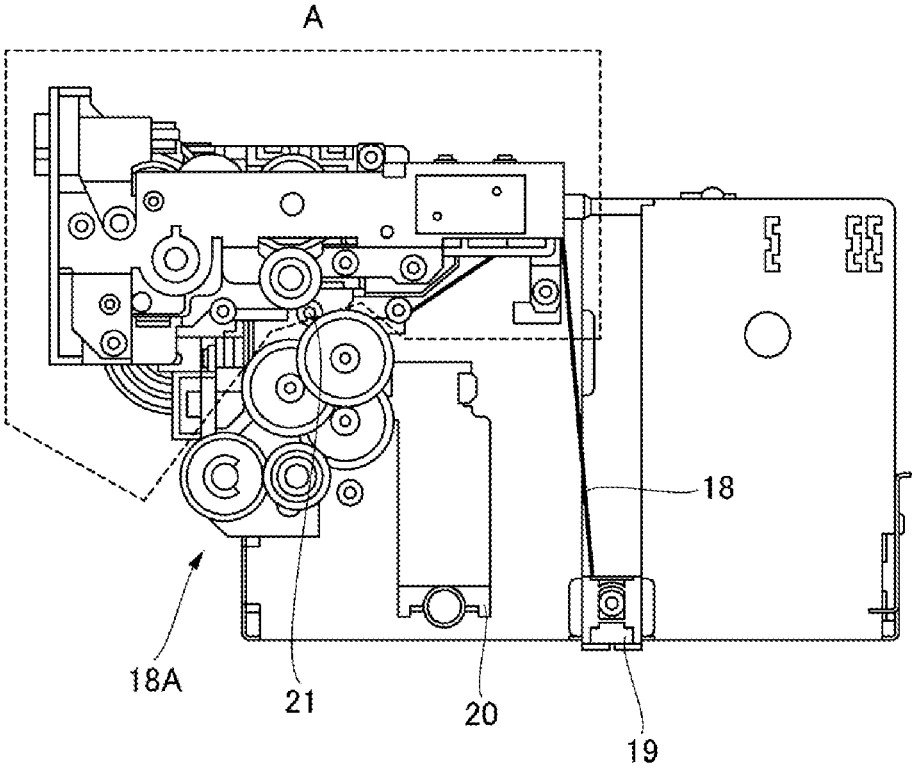
FIG. 7 is a diagram illustrating a configuration for lifting the tray.

The pickup roller 12 and the separation roller pair 11 is driven by a gear train identical to a motor 21 illustrated in FIG. 7, which will be described later. During a sheet feeding operation, the separation roller pair 11 and the pickup roller 12 are rotated in the same direction by clockwise rotation of the motor to discharge the sheet. As illustrated in FIG. 4, the pickup roller 12 is rotatably supported by a pivoting end of a pickup roller support member 13 capable of pivoting on a center shaft 25 of the conveying roller 11*a*.

In the pickup roller support member 13, when a solenoid 16 is turned on and a plunger 16*a* of the solenoid 16 is moved in the direction of an arrow X of FIG. 4, a link member 24 is rotated in the direction of an arrow R of FIG. 4. Then, by be lifted up by the front end of the rotating link member 24, the pickup roller support member 13 is pivoted upward on the center shaft 25 of the conveying roller 11*a*. Accordingly, the pickup roller 12 supported by the pickup roller support member 13 is lifted. Also, when the solenoid (SL) 16 is turned off, the plunger 16*a* of the solenoid 16 is moved in a direction opposite to the direction of the arrow X of FIG. 4, and the link member 24 is rotated in a direction opposite to the direction of the arrow R of FIG. 4. Accordingly, the pickup roller support member 13 is pivoted downward, and the pickup roller 12 is lowered to abut the sheet.

Figure 5A:
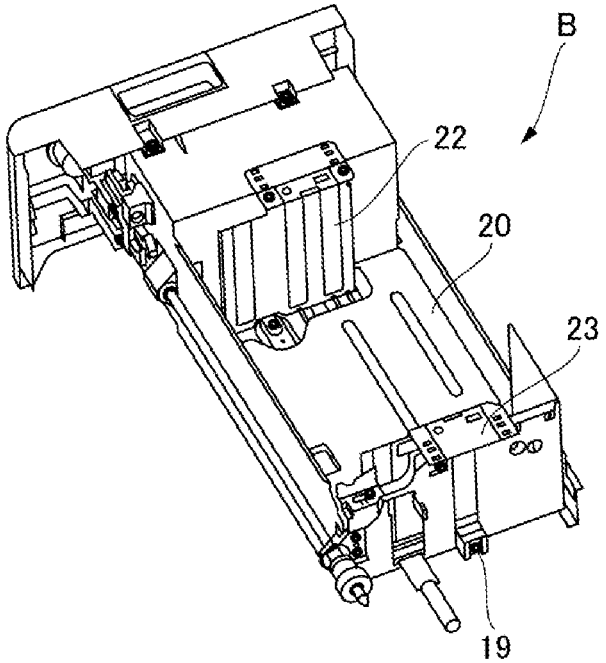
FIG. 5A is a diagram illustrating a configuration of a sheet storage portion provided in the sheet feeding apparatus.
Figure 5B:
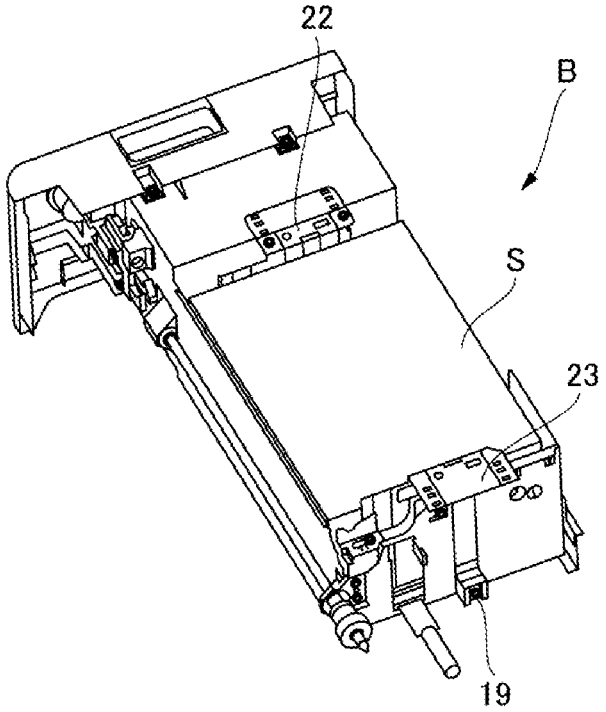
FIG. 5B is a diagram illustrating a configuration of a sheet storage portion provided in the sheet feeding apparatus.

As illustrated in FIG. 5A, in the sheet storage portion B, a tray 20 that is a sheet stacking plate on which a sheet is stacked is liftable by a lift-up mechanism which will be described later. Also, referring to FIGS. 5A and 5B, control members 22 and 23 are provided at both sides in a width direction perpendicular to the sheet feeding direction of the tray 20. As illustrated in FIG. 5B, when the sheet is stacked on the tray 20, the position of the sheet S in the width direction is controlled by the control members 22 and 23 control.

Figure 6:
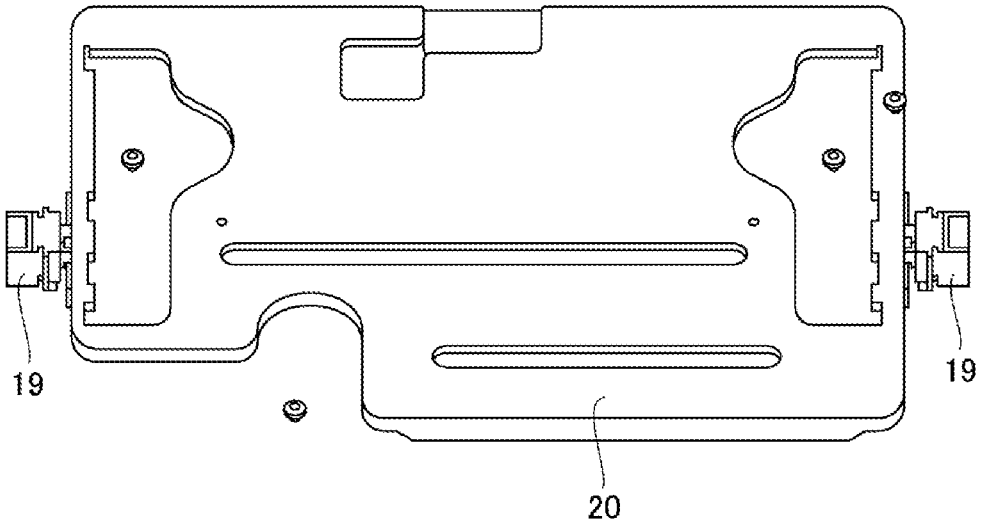
FIG. 6 is a diagram illustrating a configuration of a tray provided in the sheet storage portion.

As illustrated in FIG. 6, a fixed member 19 is fixed by a screw (not illustrated) at both ends of the tray 20 in the width direction. As illustrated in FIG. 7, one end of a wire 18 is fixed to the fixed member 19. When the motor 21 is rotated, the wire 18 is wound by a winding mechanism 18A, and the tray 20 is lifted up with the sheet stacked through the fixed member 19.

The motor 21 as a driving portion is a motor capable of rotating clockwise and counterclockwise. When feeding the sheet, the motor 21 is clockwise rotated to rotate the pickup roller, and when lifting up the tray 20, the rotation of the motor 21 is switched from clockwise rotation to counterclockwise rotation. Accordingly, both the sheet feeding operation by rotation of the pickup roller and the lift-up operation for lifting the tray 20 can be performed by using one motor 21. A lift-up mechanism is constructed by the motor 21, the wire 18, and the winding mechanism 18A.

Figure 10:
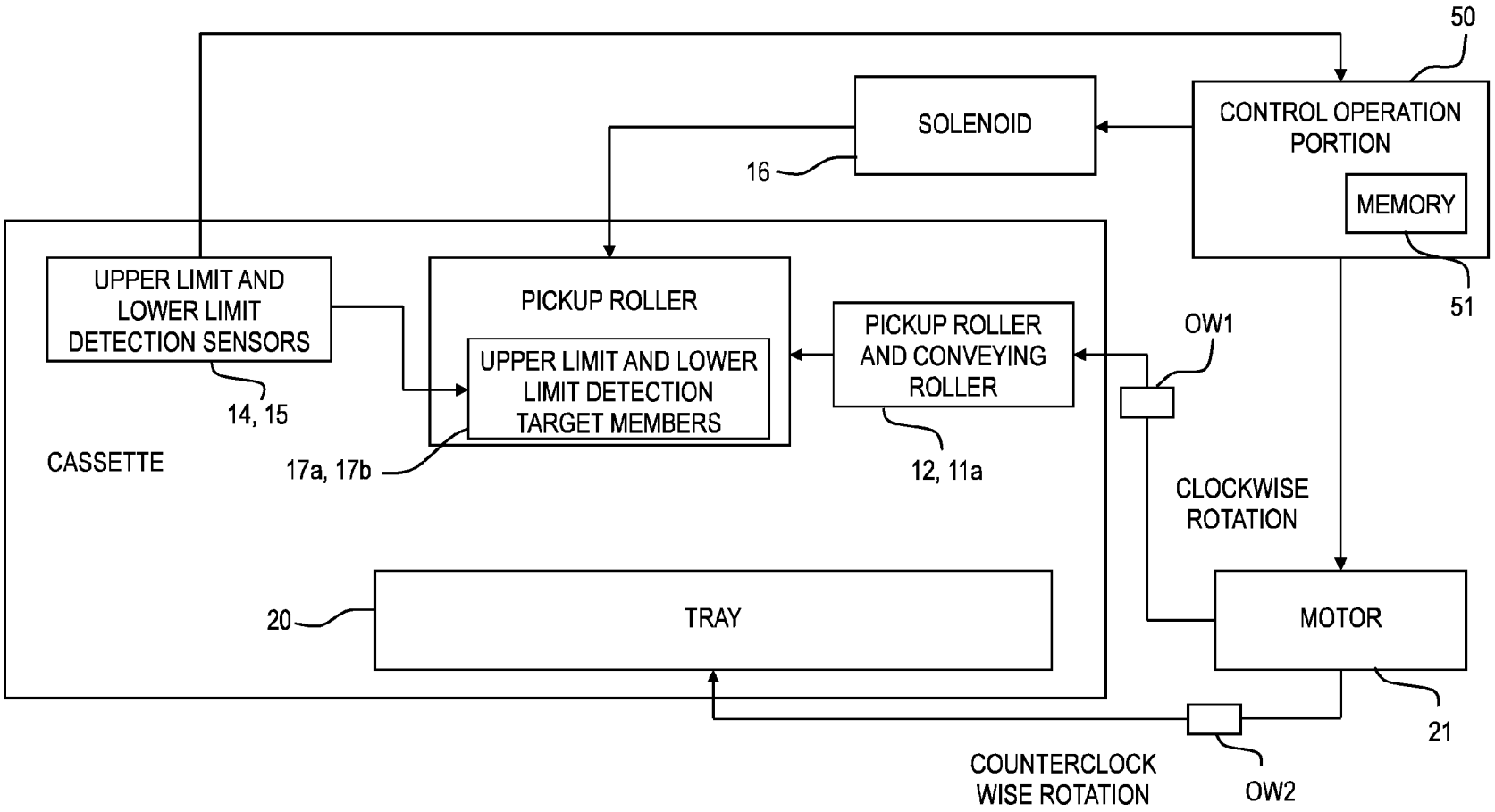
FIG. 10 is a control block diagram of the sheet feeding apparatus.

A one-way clutch OW1, which is illustrated in FIG. 10 described later, is provided between the motor 21 and the pickup roller 12. By the one-way clutch OW1, for the pickup roller 12, rotation is transmitted in clockwise motor rotation, but rotation is not transmitted in counterclockwise motor rotation. A one-way clutch OW2, which is illustrated in FIG. 10 described later, is provided between the motor 21 and the winding mechanism 18A. By the one-way clutch OW2, in counterclockwise motor rotation, driving is transmitted and the winding mechanism 18A winds the wire 18, but in counterclockwise motor rotation, driving is not transmitted and the winding mechanism 18A does not wind the wire 18.

As illustrated in FIG. 3 described previously, at the sheet feeding portion A, an upper limit detection sensor 14, which is constructed by a photosensor detecting an upper limit of a range capable of feeding the sheet supported by the tray 20, is disposed. Also, at the sheet feeding portion A, a lower limit detection sensor 15, which is a detecting portion for detecting that a position of the uppermost sheet in the height direction becomes higher by a predetermined number of sheets than a height at which the sheet cannot be fed by the pickup roller 12, is disposed. Also, the position (hereinafter referred to as sheet surface height) that is higher by a predetermined number of sheets than the height at which the sheet cannot be fed will be referred to as a lower-limit position. When the number of sheet is increased, the range capable of feeding the sheet is narrowed and the frequency of a lift-up operation increases. Therefore, the predetermined number may be about 1 to 6.

Figure 8:
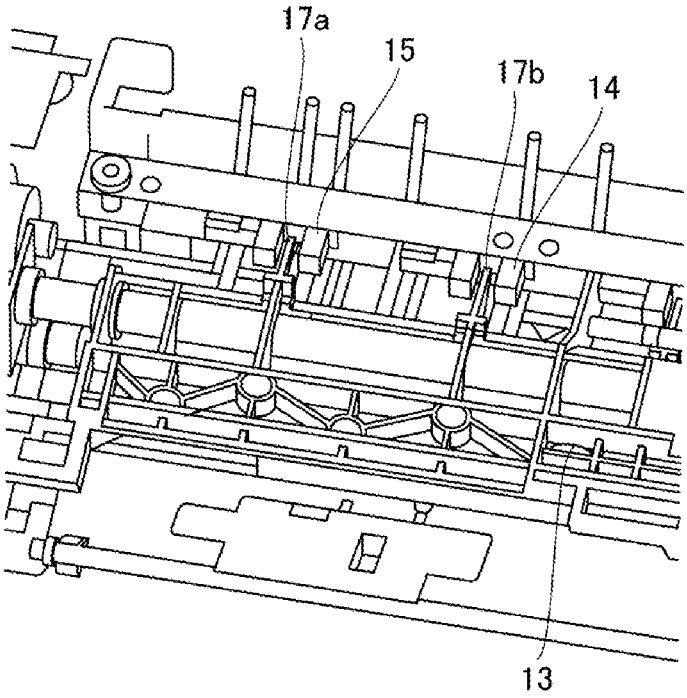
FIG. 8 is a diagram illustrating an arrangement of an upper limit detection sensor, a lower limit detection sensor, an upper limit detection target member, and a lower limit detection target member provided in the sheet feeding apparatus.

Also, as illustrated in FIG. 8, the pickup roller support member 13 capable of pivoting in a vertical direction is provided with an upper limit detection sensor 14, a lower limit detection sensor 15, an upper limit detection target member 17*a*, and a lower limit detection target member 17*b*. When the pickup roller support member 13 is pivoted, the upper limit detection target member 17*a* and the lower limit detection target member 17*b* are simultaneously pivoted in the vertical direction. The pivoting angle of the pickup roller support member 13 changes according to the position at which the lowered pickup roller 12 abuts the sheet. In other words, the pivoting angle of the pickup roller support member 13 changes according to the position (sheet surface height) of the uppermost sheet stacked on the tray 20.

Figure 9A:
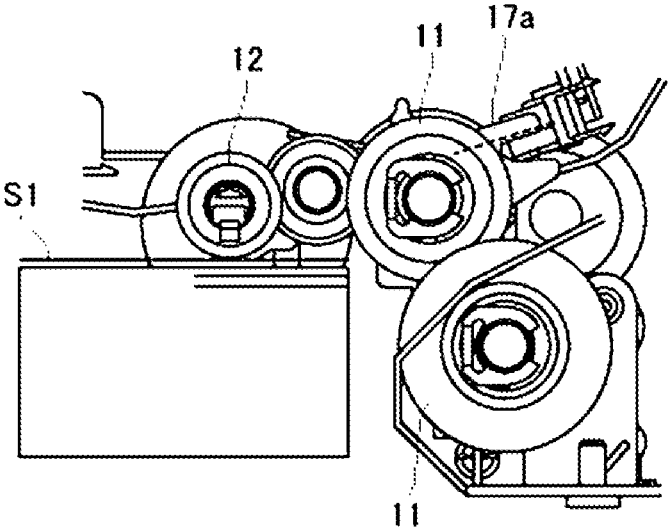
FIG. 9A is a diagram describing the detection of a sheet surface height by the upper limit detection sensor and the lower limit detection sensor (upper-limit state)
Figure 9B:
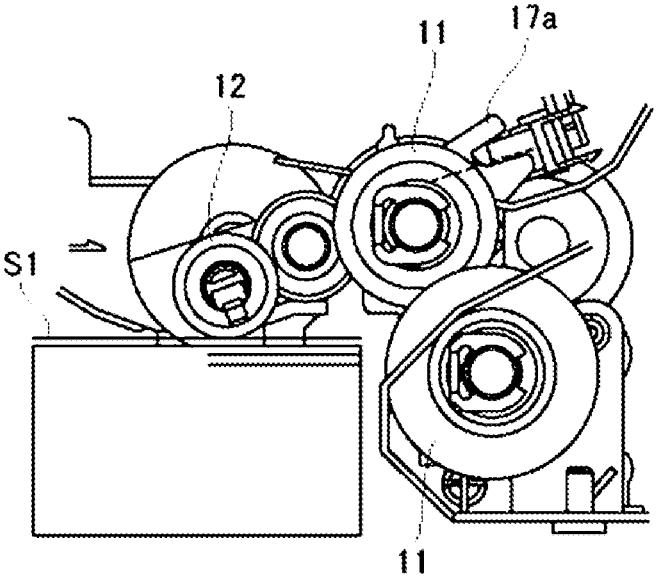
FIG. 9B is a diagram describing the detection of a sheet surface height by the upper limit detection sensor and the lower limit detection sensor (lower-limit state)

For example, as illustrated in FIG. 9A, when the position (sheet surface height) of the uppermost sheet S1 is the upper-limit position, the upper limit detection sensor 14 that is an upper limit detecting portion detects the upper limit detection target member 17*a*. Also, as illustrated in FIG. 9B, when the position (sheet surface height) of the uppermost sheet S1 is the lower-limit position, the lower limit detection sensor 15 detects the lower limit detection target member 17*b*.

FIG. 10 is a control block diagram of the sheet feeding apparatus 60C. Referring to FIG. 10, a controller 50 is connected to the body controller 120 to control the sheet feeding apparatus 60C. The upper limit detection sensor 14 and the lower limit detection sensor 15 are connected to the controller 50. When the upper limit detection sensor 14 and the lower limit detection sensor 15 detect the upper limit detection target member 17*a* and the lower limit detection target member 17*b*, a detection signal is input to the controller 50.

Also, the motor 21 that is a driving source capable of rotating clockwise and counterclockwise is connected to the controller 50. When the motor 21 is clockwise rotated by the controller 50, the pickup roller 12 and the conveying roller 11*a* are rotated; and when the motor 21 is counterclockwise rotated by the controller 50, the wire 18 is wound and the fixed member 19 is lifted up, so that the tray 20 is lifted up. Also, a memory 51 is provided at the controller 50.

Figure 11:
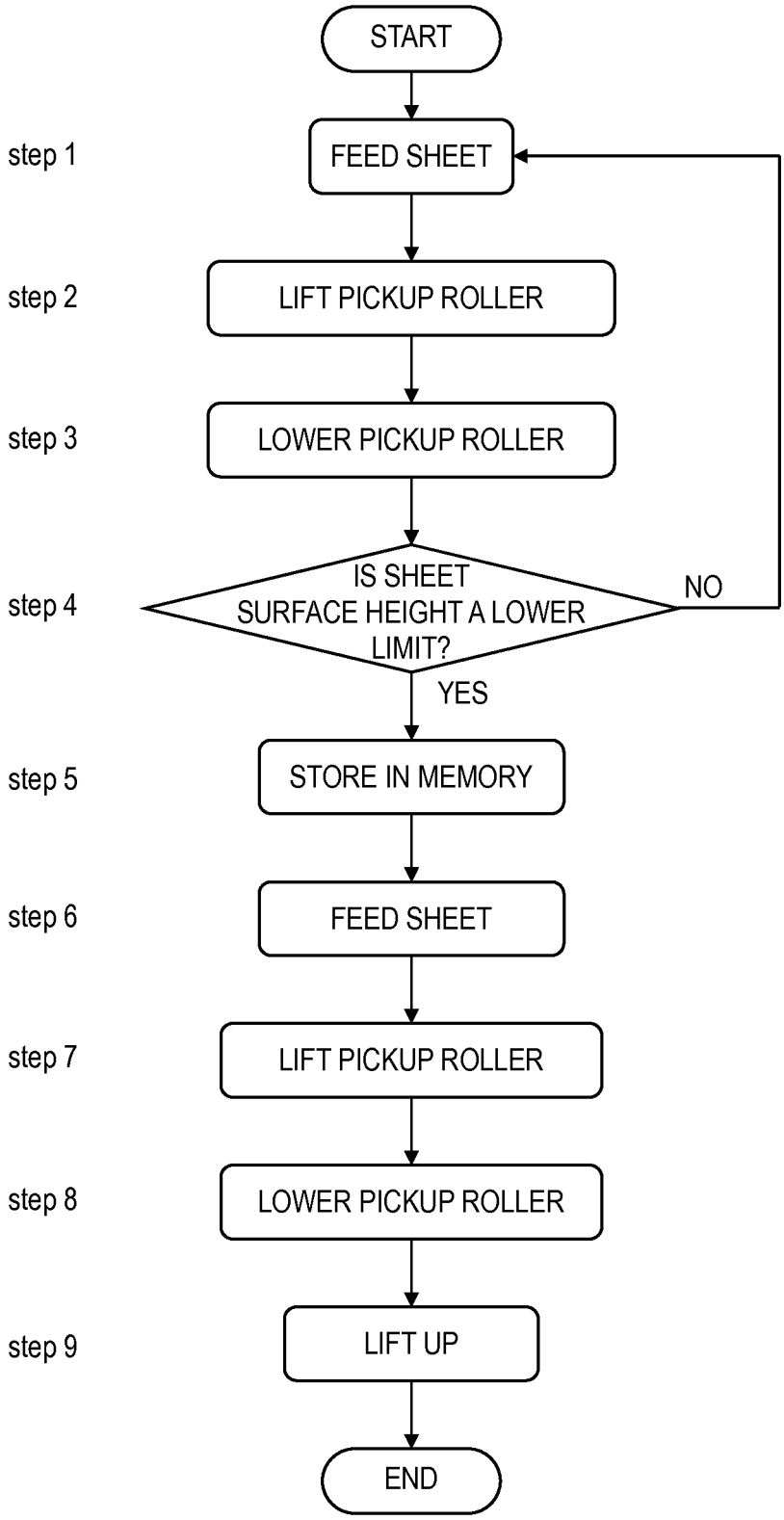
FIG. 11 is a flowchart describing a sheet feeding operation control of the sheet feeding apparatus.

Next, a sheet feeding operation control of the sheet feeding apparatus 60C according to the present embodiment will be described with reference to a flowchart illustrated in FIG. 11.

When receiving a feeding signal from the body controller 120, the controller 50 rotates the motor 21 clockwise and rotates the pickup roller 12 and the conveying roller 11*a* to feed the sheet (step 1). Thereafter, in order to prevent a load of the sheet fed by the pickup roller 12, the controller 50 turns on the solenoid 16 to lift up the pickup roller 12 (step 2). Thereafter, for feeding the next sheet, the controller 50 turns off the solenoid 16 to lower the pickup roller 12 located on the tray 20 (step 3). Thereafter, the controller 50 determines whether the sheet surface height becomes the lower-limit position (lower-limit sheet surface height) (step 4).

Also, the pickup roller 12 is lifted by turning on the solenoid 16 after a lapse of a predetermined time from the discharge of the sheet, and the pickup roller 12 is lowered by turning off the solenoid 16 substantially at the same time when the rear end of the fed sheet passes the separation roller pair 11. The timing of lowering the pickup roller 12 is determined by pre-storing a time of the rear end of the sheet passing the separation roller pair 11 from the feeding signal as data in the memory 51 and detecting a time point when the time lapses by a counter or the like. Also, the timing of lowering the pickup roller 12 may be determined by disposing a sensor at the downstream side of the separation roller pair 11 and detecting a time point when the sensor detects the rear end of the sheet.

When the lower limit detection sensor 15 fails to detect the lower limit detection target member 17*b*, that is, when the sheet surface height is not the lower-limit position (lower-limit sheet surface height) (NO in step 4), the next sheet is fed. Also, in an embodiment of the present invention, the timing of detecting the sheet surface height is 50 ms from a pickup roller lowering start signal from the mechanical operation time and the electrical delay by the solenoid 16.

Figure 14:
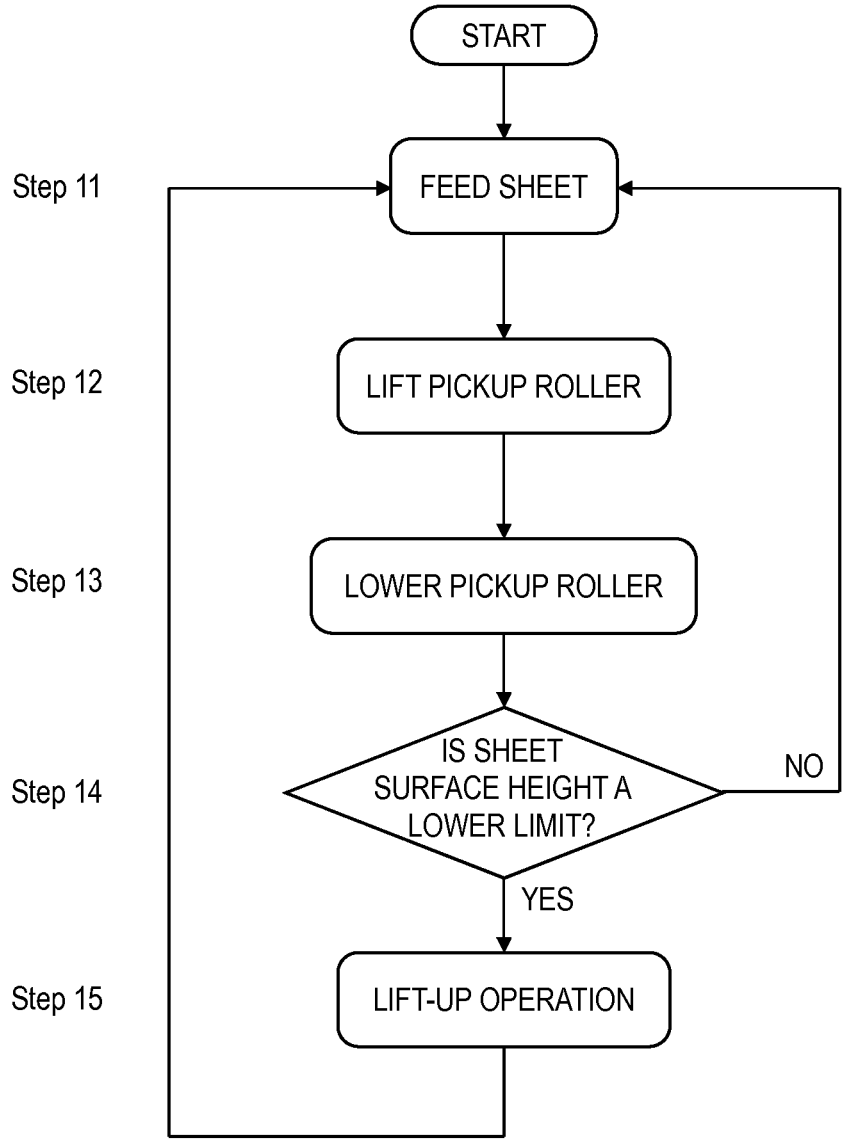
FIG. 14 PRIOR ART
FIG. 14 is a flowchart of a sheet feeding sequence of the sheet feeding apparatus according to the related art.

On the other hand, when the sheet surface height is the lower-limit position (lower-limit sheet surface height) (YES in step 4), a time of 250 ms is required as described previously, when detecting the sheet surface state, determining the lower-limit position, and then performing a lift-up operation of the tray 20 by the lift-up mechanism, as in the sequence of the related art illustrated in FIG. 14 described previously. In the case of desiring to performing sheet feeding at a sheet feeding interval that cannot be provided, when the motor correction time is prioritized, the duration of a lift-up operation becomes inefficient; and when the lift-up operation of the tray 20 by the lift-up mechanism is prioritized, the motor correction time becomes insufficient.

Therefore, in the present embodiment, when determining that the sheet surface height is the lower-limit position (lower-limit sheet surface height) (YES in step 4), the controller 50 stores information indicating that the lower-limit position is detected in the memory 51 (step 5), and then performs sheet feeding (step 6). Next, the solenoid 16 is turned on to lift the pickup roller 12 (step 7). Thereafter, for next sheet feeding, the solenoid 16 is turned off to lower the pickup roller 12 (step 8). Next, immediately after the lower of the pickup roller 12, the lift-up operation of the tray 20 by the lift-up mechanism is performed (step 9).

The lift-up operation is performed until the upper limit detection sensor 14 detects the upper limit detection target member 17*a* provided at the pickup roller support member 13. Also, the lift-up operation may be performed during a predetermined time after the detection of the lower limit detection target member 17*b* by the lower limit detection sensor 15, or may be performed until the sheet surface height becomes a range capable of sheet feeding, based on the detection of the detection sensor. Accordingly, the uppermost sheet S1 is located within the range capable of sheet feeding, and the lift-up operation of the tray 20 by the lift-up mechanism is ended.

That is, in the present embodiment, even when the pickup roller 12 is lowered and the lower-limit position is detected, the lift-up operation of the tray 20 by the lift-up mechanism is not performed and a next sheet feeding operation is performed. After the sheet feeding operation, a lift-up operation is initiated up to the next sheet feeding. When the lower-limit position is detected to enable this control, the fact that the lower-limit position is detected is stored in the memory 51, as described previously. By storing the fact that the lower-limit position is detected in the memory 51, it is possible to perform the lift-up operation of the tray 20 by the lift-up mechanism in the next sheet feeding without determining whether the sheet surface height is the lower-limit position.

Figure 12A:
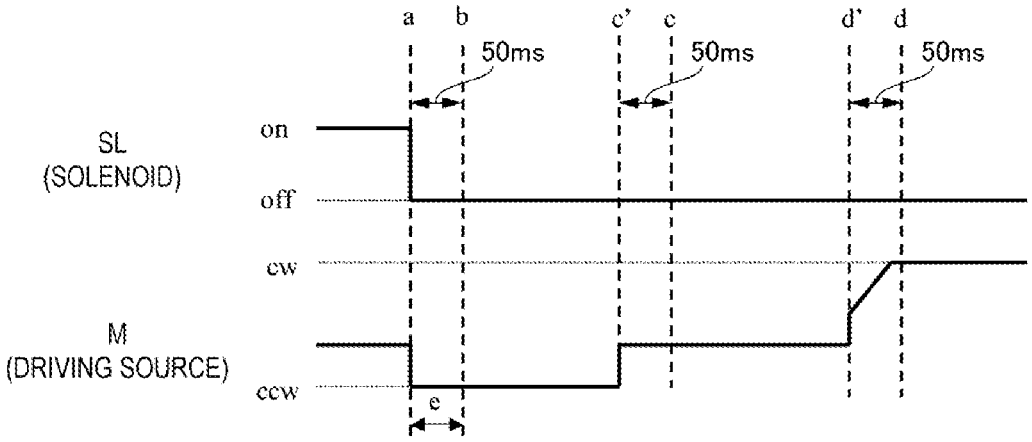
FIG. 12A is a timing chart of the sheet feeding operation of the sheet feeding apparatus.
Figure 12B:
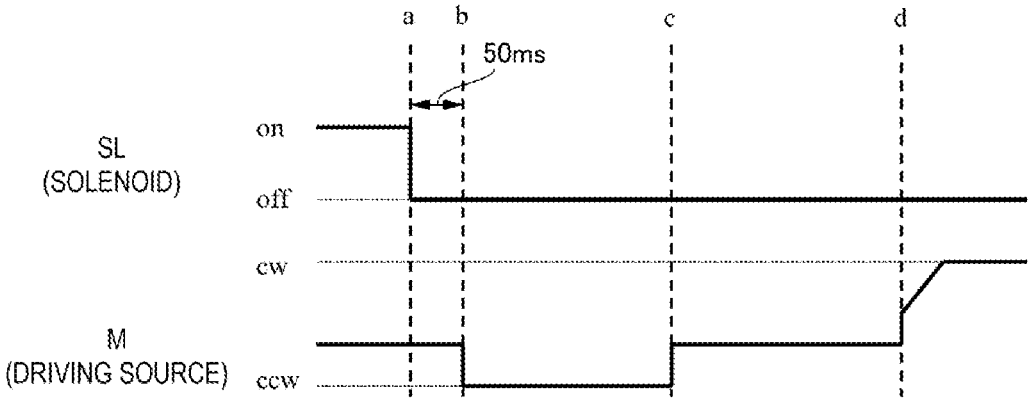
FIG. 12B PRIOR ART
FIG. 12B is a timing chart of a sheet feeding operation of a sheet feeding apparatus according to the related art.

FIG. 12A is a timing chart of a sheet feeding operation according to the present embodiment, and FIG. 12B is a timing chart of a sheet feeding operation of a sheet feeding apparatus according to the related art. In the related art, at the timing "a" of FIG. 12B, it is determined from a lowering signal (solenoid SL is turned on) of the pickup roller 12 whether a lift-up operation is necessary after the pickup roller 12 reaches the sheet surface. When the lift-up of the tray 20 by the lift-up mechanism is necessary, a lift-up operation is started by rotating the motor M counterclockwise (CCW) at the time "b" of FIG. 12B after 50 ms.

On the other hand, in the present embodiment, the necessity of the lift-up operation of the tray 20 by the lift-up mechanism has already been determined at the time of feeding the previous sheet in sheet feeding. That is, when the lower-limit position is detected, information indicating the detection of the lower-limit position is stored in the memory 51, and the lift-up operation is not immediately performed at the time of detection of the lower-limit position. Therefore, after determining that the lift-up operation is necessary, when feeding the next sheet, without determining whether the sheet surface height is the lower-limit position, at the timing "a" of FIG. 12A, the lift-up operation of the tray 20 by the lift-up mechanism is started by lowering the pickup roller 12 and rotating the motor M counterclockwise (CCW). Accordingly, the lift-up end timing becomes c' of FIG. 12A, which is earlier by 50 ms than the timing c of FIG. 12A according to the related art. As a result, the sheet feeding timing becomes d' of FIG. 12A, which is earlier by 50 ms than the timing d of FIG. 12A according to the related art.

Also, in the present invention, when the sheet surface height is not the lower-limit position, the sheet surface height is determined at the next sheet feeding. However, the determination of the sheet surface height is performed at the timing after 50 ms from the lowering signal of the pickup roller 12 of b of FIG. 12A. This is because, as described above, until the lapse of 50 ms from the lowering signal of the pickup roller 12, the operation of the pickup roller 12 is not stabilized due to the state of the pickup roller 12 not being lowered, the delay of the operation of the solenoid, and the vibration by landing.

Thus, in order to perform the determination of the sheet surface height in the state where the operation of the pickup roller 12 is stabilized, in the present embodiment, this interval, that is, the interval e of FIG. 12A is determined as a mask interval in which the state of the sensor is not monitored. Also, in the case where this mask interval is provided, as in the present embodiment, when the pickup roller 12 is lowered and simultaneously the lift-up of the tray 20 by the lift-up mechanism is started, because the sheet surface height cannot be detected, there is a fear that it reaches the upper-limit sheet surface height.

However, in the present invention, the mask interval is set to 50 ms, and when the lift-up operation of the tray 20 by the lift-up mechanism is started from the lower-limit position capable of stably sheet feeding, 50 ms or more is required until the upper limit value of a range capable of sheet feeding is reached. Accordingly, there is no possibility that the sheet surface height reaches the upper limit capable of stable sheet feeding during the mask interval, that is, a period of 50 ms.

In this manner, in the present embodiment, the sequence can provide a time reduction of 50 ms and can feed the next sheet in 200 ms (an interval of a~d' in FIGS. 5A and 5B). Accordingly, the sheet feeding interval can be shortened by securing a stable sheet feeding operation without increasing the cost. In the present embodiment, the productivity is increased from 75 ppm to 80 ppm.

As described above, in the present embodiment, when the pickup roller 12 abuts the uppermost sheet, whether the sheet surface height becomes the lower-limit position is determined based on the detection signal from the lower limit detection sensor 15. Then, when it is determined that the sheet surface height becomes the lower-limit position, after feeding the uppermost sheet, without performing detection by the lower limit detection sensor 15, the tray 20 is lifted up such that the uppermost sheet is located within an appropriate range.

That is, when the sheet surface height becomes the lower-limit position, the tray 20 is lifted up at the time of feeding the next sheet after feeding the uppermost sheet, thereby shortening the sheet feeding interval. Accordingly, the productivity can be improved.

Figure 13:
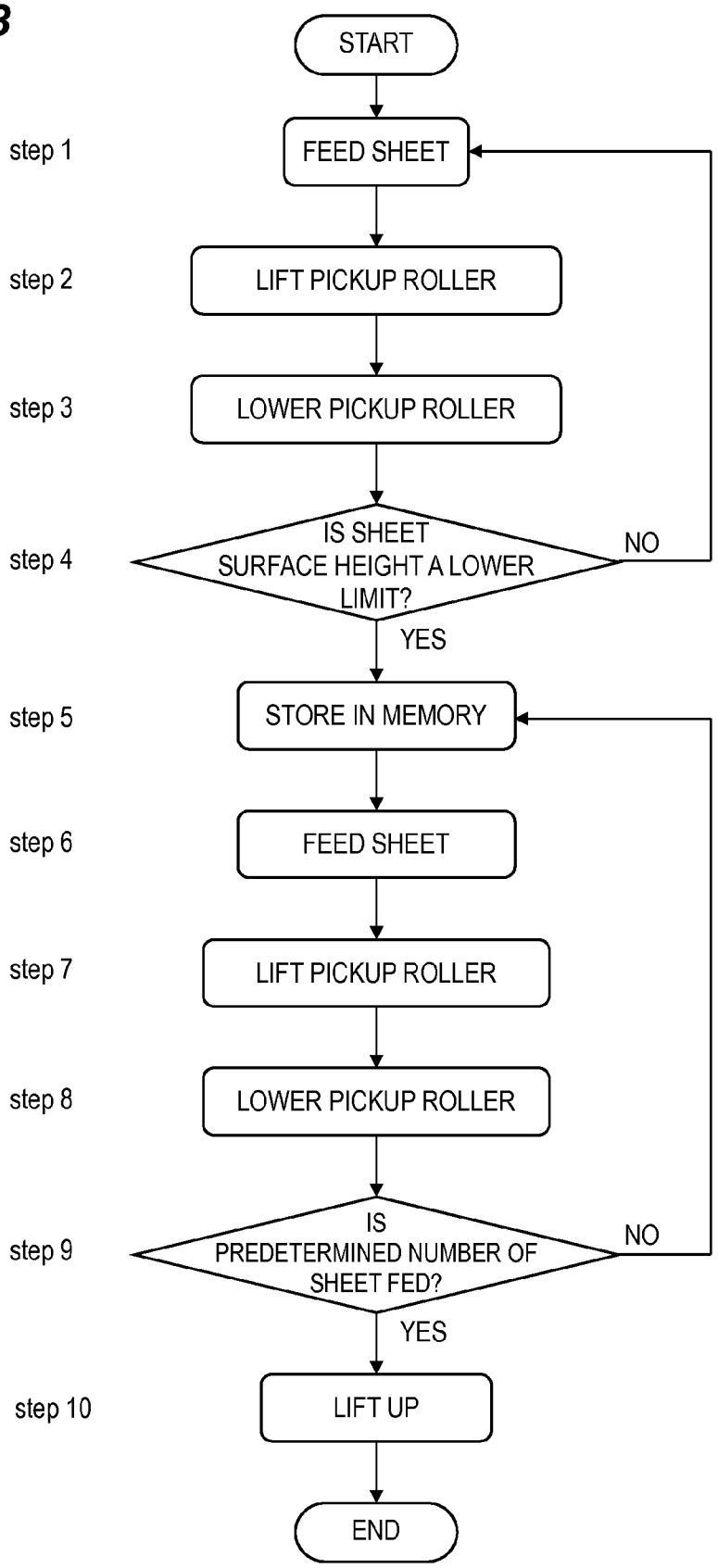
FIG. 13 is a flowchart describing another sheet feeding operation control of the sheet feeding apparatus.

Also, in the present embodiment, the lift-up operation is performed after feeding the uppermost sheet after detecting the lower-limit position; however, the lift-up operation of the tray 20 by the lift-up mechanism may be performed after feeding a predetermined number of sheets as illustrated in the flowchart of FIG. 13. Also, since step 1 to step 3 in the flowchart of FIG. 13 is the same as those in the flowchart of FIG. 11, a description thereof will not be repeated.

In this case, when determining that the sheet surface height is the lower-limit position (lower-limit sheet surface height) (YES in step 4), the controller 50 stores information indicating that the lower-limit position is detected in the memory 51 (step 5), and then performs sheet feeding (step 6). Next, the solenoid 16 is turned on to lift the pickup roller 12 (step 7). Thereafter, for next sheet feeding, the solenoid 16 is turned off to lower the pickup roller 12 (step 8). Next, when a predetermined number of sheet are fed (YES in step 9), the lift-up operation of the tray 20 by the lift-up mechanism is performed (step 10).

In the case of this control, since the installation position of the lower limit detection sensor 15 is set to be higher by a predetermined number of sheets than the sheet surface height incapable of sheet feeding by the pickup roller 12, a predetermined number of sheets can be fed although the frequency of the lift-up operation of the tray 20 by the lift-up mechanism is increased. In this case, a predetermined number of consecutive sheets can be fed without detecting the sheet surface height.

Also, when the predetermined number is set to be great, since the lower-limit position is high, the range is narrowed from the lower-limit position to the upper limit of an appropriate range. Therefore, the installation position of the lower limit detection sensor 15 should be set within a height range in which the height of the sheet being lifted during the mask interval does not reach the upper limit of an appropriate range after detecting the lower limit. This is because, when the sheet surface height of the uppermost sheet exceeds the upper limit, the tray 20 needs to be lowered; however, in this case, when the motor 21 is rotated clockwise, there is a possibility that the pickup roller 12 is rotated counterclockwise and thus the sheet is jammed.

Although it has been described above that the upper limit of the sheet surface is detected according to the lowering of the pickup roller 12, the present invention is not limited thereto. For example, when a detection mechanism for detection of the upper limit of the sheet surface is separately provided at a portion irrelevant to the lowering of the pickup roller 12, the lift-up operation of the tray 20 by the lift-up mechanism can be stopped regardless of the lowering of the pickup roller 12.

Also, it has been exemplarily described in the present embodiment that the sheet feeding operation by the pickup roller is performed by the clockwise rotation of the motor and the lift-up operation of the tray is performed by the counterclockwise rotation of the motor; however, the present invention is not limited thereto. That is, in the above embodiment, since two operations can be performed in one motor, the cost can be effectively reduced; however, since the motor correction time is necessary, the sheet feeding interval is restricted. On the other hand, although the cost cannot be effectively reduced, the present invention can also be applied to a sheet feeding method in which a dedicated motor is used to perform the respective operations. That is, even in this method, a time reduction of 50 ms can be achieved, and the sheet feeding interval can be reduced, thereby improving the productivity.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-196979, filed Sep. 7, 2012, which is hereby incorporated by reference herein in its entirety.

What is claimed is:

1. A sheet feeding apparatus comprising:

a sheet storage portion including a sheet stacking portion which is capable of lifting and lowering and on which a plurality of sheets are stacked;

a lift-up mechanism which lifts the sheet stacking portion;

a sheet feeding portion which is capable of lifting and lowering and is lowered to abut a top surface of sheets stacked on the sheet stacking portion and feeds the sheet;

a detecting portion which outputs a detection signal according to a position of the sheet feeding portion while the sheet feeding portion abuts the top surface of the sheets stacked on the sheet stacking portion; and a controller which determines if a sheet surface height of the top surface of the sheets stacked on the sheet stacking portion is positioned in a feed range capable of feeding an uppermost sheet of the sheets stacked on the sheet stacking portion based on the detection signal from the detecting portion and controls the lift-up mechanism so as to lift up the sheet stacking portion based on a determination of the sheet surface height of the top surface of the sheets, wherein the controller provides a mask interval in which the detection signal is not received from the detecting portion until a lapse of a predetermined time from starting to lower the sheet feeding portion, and the determination of the sheet surface height of the top surface of the sheets stacked on the sheet stacking portion by the controller is performed after a lapse of the mask interval from a start of a lowering of the sheet feeding portion for feeding the uppermost sheet, and wherein, in a case that the controller has determined that the sheet surface height of the top surface of the sheets stacked on the sheet stacking portion is at or lower than a lower-limit height that is preset in the feed range, the controller controls the lift-up mechanism to lift the sheet stacking portion such that the sheet surface height of the top surface of the sheets is lifted higher than the lower-limit height based on the determination that the controller has determined previously after the sheet feeding portion finishes feeding the uppermost sheet.

2. The sheet feeding apparatus according to claim 1, wherein an upper-limit height and the lower-limit height are preset for sheet feeding, and the sheet feeding portion can feed the uppermost sheet when the sheet surface height of the top surface of the sheets on the sheet stacking portion is located between the upper-limit height and the lower-limit height.

3. The sheet feeding apparatus according to claim 2, wherein the lower-limit height is preset to a sheet surface height that is higher by a predetermined number of sheets than a sheet surface height corresponding to a lower limit of a range in which sheet feeding by the sheet feeding portion is possible.

4. The sheet feeding apparatus according to claim 1, further comprising an upper limit detecting portion which is configured to detect that the sheet surface height of the top surface of the sheets stacked on the sheet stacking portion reaches the upper-limit height of a predetermined range, wherein the detecting portion is provided at a position where the uppermost sheet lifting in the mask interval is not detected by the upper limit detecting portion when the sheet stacking portion is lifted.

5. The sheet feeding apparatus according to claim 1, further comprising a driving portion provided in the lift-up mechanism, wherein the driving portion drives the sheet feeding portion by clockwise rotation and drives the lift-up mechanism by counterclockwise rotation to lift the sheet stacking portion.

6. An image forming apparatus comprising:

a sheet storage portion including a sheet stacking portion which is capable of lifting and lowering and on which a plurality of sheets are stacked;

a lift-up mechanism which lifts the sheet stacking portion;

a sheet feeding portion which is capable of lifting and lowering and is lowered to abut a top surface of sheets stacked on the sheet stacking portion and feed the sheet;

a detecting portion which outputs a detection signal according to a position of the sheet feeding portion while the sheet feeding portion abuts the top surface of the sheets stacked on the sheet stacking portion; and a controller which determines if a sheet surface height of the top surface of the sheets stacked on the sheet stacking portion is positioned in a feed range capable of feeding an uppermost sheet of the sheets stacked on the sheet stacking portion based on the detection signal from the detecting portion and controls the lift-up mechanism so as to lift up the sheet stacking portion based on a determination of the sheet surface height of the top surface of the sheets, wherein the controller provides a mask interval in which the detection signal is not received from the detecting portion until a lapse of a predetermined time from starting to lower the sheet feeding portion, and the determination of the sheet surface height of the top surface of the sheets stacked on the sheet stacking portion by the controller is performed after a lapse of the mask interval from a start of a lowering of the sheet feeding portion for feeding the uppermost sheet, wherein, in a case that the controller has determined that the sheet surface height of the top surface of the sheets stacked on the sheet stacking portion is at or lower than a lower-limit height that is preset in the feed range, the controller controls the lift-up mechanism so as to lift the sheet stacking portion such that the sheet surface height of the top surface of the sheets is lifted higher than the lower-limit height based on the determination that the controller has determined previously after the sheet feeding portion finishes feeding the uppermost sheet; and an image forming portion which forms an image on a sheet fed from the sheet feeding portion.

7. The image forming apparatus according to claim 6, wherein the lower-limit height is preset to a sheet surface height that is higher by a predetermined number of sheets than a sheet surface height corresponding to a lower limit of a range in which sheet feeding by the sheet feeding portion is possible.

8. The image forming apparatus according to claim 6, further comprising an upper limit detecting portion which is configured to detect that the sheet surface height of the top surface of the sheets stacked on the sheet stacking portion reaches the upper-limit height of a predetermined range, wherein the detecting portion is provided at a position where the uppermost sheet lifting in the mask interval is not detected by the upper limit detecting portion when the sheet stacking portion is lifted.

9. The image forming apparatus according to claim 6, further comprising a driving portion provided in the lift-up mechanism, wherein the driving portion drives the sheet feeding portion by clockwise rotation and drives the lift-up mechanism by counterclockwise rotation to lift the sheet stacking portion.

10. A sheet feeding apparatus comprising:

a sheet storage portion including a sheet stacking portion which is capable of lifting and lowering and on which sheets are stacked;

a lift-up mechanism which lifts the sheet stacking portion;

a sheet feeding portion which is capable of lifting and lowering and is lowered to abut a top surface of a sheet stacked on the sheet stacking portion and feed the sheet;

a detecting portion which outputs a detection signal according to a position of the sheet feeding portion while the sheet feeding portion abuts the top surface of the sheets stacked on the sheet stacking portion;

a controller which determines whether a sheet surface height of the top surface of the sheets stacked on the sheet stacking portion is at or lower than a lower-limit height that is preset based on the detection signal from the detecting portion; and a memory which stores information of a determination that the sheet surface height of the top surface of the sheets is at or lower than the lower-limit position, determined by the controller based on the detection signal from the detecting portion, wherein, in a case that the controller has determined that the sheet surface height of the top surface of the sheets stacked on the sheet stacking portion is the lower-limit height, the memory stores the information of the determination, and the controller controls the lift-up mechanism so as to lift the sheet stacking portion such that the sheet surface height of the top surface of the sheets becomes higher than the lower-limit height based on the information of the determination stored in the memory after a predetermined number of sheets are fed by the sheet feeding portion from a time determining the lower-limit height by the controller.

11. The sheet feeding apparatus according to claim 10, wherein the lower-limit height is preset to a sheet surface height that is higher by a predetermined number of sheets than a sheet surface height corresponding to a lower limit of a range in which sheet feeding by the sheet feeding portion is possible.

12. The sheet feeding apparatus according to claim 10, wherein when determining that the sheet surface height of the top surface of the sheets stacked on the sheet stacking portion is the lower-limit height based on the detection signal from the detecting portion, the controller controls the lift-up mechanism such that the sheet stacking portion is lifted simultaneously with starting to lower the sheet feeding portion, when feeding a next sheet after the predetermined number of sheets are fed.

13. The sheet feeding apparatus according to claim 12, wherein when detecting the sheet surface height of the top surface of the sheets stacked on the sheet stacking portion, the controller provides a mask interval in which the detection signal is not received from the detecting portion until a lapse of a predetermined time from starting to lower the sheet feeding portion.

14. An image forming apparatus comprising:

a sheet storage portion including a sheet stacking portion which is capable of lifting and lowering and on which a sheet is stacked;

a lift-up mechanism which lifts the sheet stacking portion;

a sheet feeding portion which is capable of lifting and lowering and is lowered to abut a top surface of a sheet stacked on the sheet stacking portion and feed the sheet;

a detecting portion which outputs a detection signal according to a position of the sheet feeding portion while the sheet feeding portion abuts a top surface of the sheets stacked on the sheet stacking portion;

a controller which determines whether a sheet surface height of the top surface of the sheets stacked on the sheet stacking portion is at or lower than a lower-limit height that is preset based on the detection signal from the detecting portion;

a memory which stores information of a determination that the sheet surface height of the top surface of the sheets is at or lower than the lower-limit position, determined by the controller based on the detection signal from the detecting portion, wherein, in a case that the controller has determined that the sheet surface height of the top surface of the sheets is the lower-limit height, the memory stores the information of the determination, and the controller controls the lift-up mechanism so as to lift the sheet stacking portion such that the sheet surface height of the uppermost sheet becomes higher than the lower-limit height based on the information of the determination stored in the memory after a predetermined number of sheets are fed by the sheet feeding portion from a time the controller determines the lower-limit height; and an image forming portion which forms an image on a sheet fed from the sheet feeding portion.

15. The image forming apparatus according to claim 14, wherein the lower-limit height is preset to a sheet surface height that is higher by a predetermined number of sheets than a sheet surface height corresponding to a lower limit of a range in which sheet feeding by the sheet feeding portion is possible.

16. The image forming apparatus according to claim 14, wherein when determining that the sheet surface height of the top surface of the sheets stacked on the sheet stacking portion is the lower-limit height based on the detection signal from the detecting portion, the controller controls the lift-up mechanism such that the sheet stacking portion is lifted simultaneously with starting to lower the sheet feeding portion, when feeding a next sheet after the predetermined number of sheets are fed.

17. The image forming apparatus according to claim 16, wherein when detecting the sheet surface height of the top surface of the sheets stacked on the sheet stacking portion, the controller provides a mask interval in which the detection signal is not received from the detecting portion until a lapse of a predetermined time from starting to lower the sheet feeding portion.

* * * * *